United States Patent [19]

Mitchell et al.

[11] 4,047,879

[45] Sept. 13, 1977

[54] OIL BURNER ASSEMBLY

[75] Inventors: Earl R. Mitchell; Thomas D. Brown; Beverley C. Post, all of Ottawa, Canada

[73] Assignee: Canadian Patents and Development Limited, Ottawa, Canada

[21] Appl. No.: 692,461

[22] Filed: June 3, 1976

[30] Foreign Application Priority Data

June 27, 1975 Canada ..... 230344

[51] Int. Cl.[2] ..... F23C 5/06

[52] U.S. Cl. ..... 431/183; 239/402; 239/577; 431/265; 431/266

[58] Field of Search ..... 431/265, 182, 183, 186, 431/266; 239/569, 577, 399, 402, 405

[56] References Cited

U.S. PATENT DOCUMENTS

| | | | |
|---|---|---|---|
| 2,308,439 | 1/1943 | Carroll | 431/265 X |
| 3,852,022 | 12/1974 | Medeot et al. | 431/186 |

*Primary Examiner*—Edward G. Favors
*Attorney, Agent, or Firm*—Francis W. Lemon

[57] ABSTRACT

A blue flame oil burner is provided wherein an oil atomizing nozzle produces sprayed oil droplets as a symetrical hollow cone having an included angle for the outside edge of the oil spray, when the oil is sprayed in still air, in the range 60° to 80°, an air swirler with an air pre-swirler both have blades with a helix angle in the range 50° to 65°, with the blades of the air swirler adjacent the spraying end of the atomizing nozzle inclined in the direction of the hollow cone at an angle in the range 20° to 55°, and a supply tube for delivering air through the air pre-swirler to the air swirler. The air flows along the supply tube and is preswirled in the pre-swirler and then finally swirled in the air swirler so that sprayed oil droplets in the hollow cone are carried by the swirling air, which diffuses with them in such a manner that the oil droplets are evaporated prior to combustion and:

i. a substantially uniformly distributed air flow is produced to the flame, ii. a substantially stable recirculation vortex to the flame is produced, and iii. a region of rapid oil droplet/air mixing is established, resulting in a surprisingly stable blue flame.

4 Claims, 14 Drawing Figures

OIL BURNER ASSEMBLY

Figure 1:
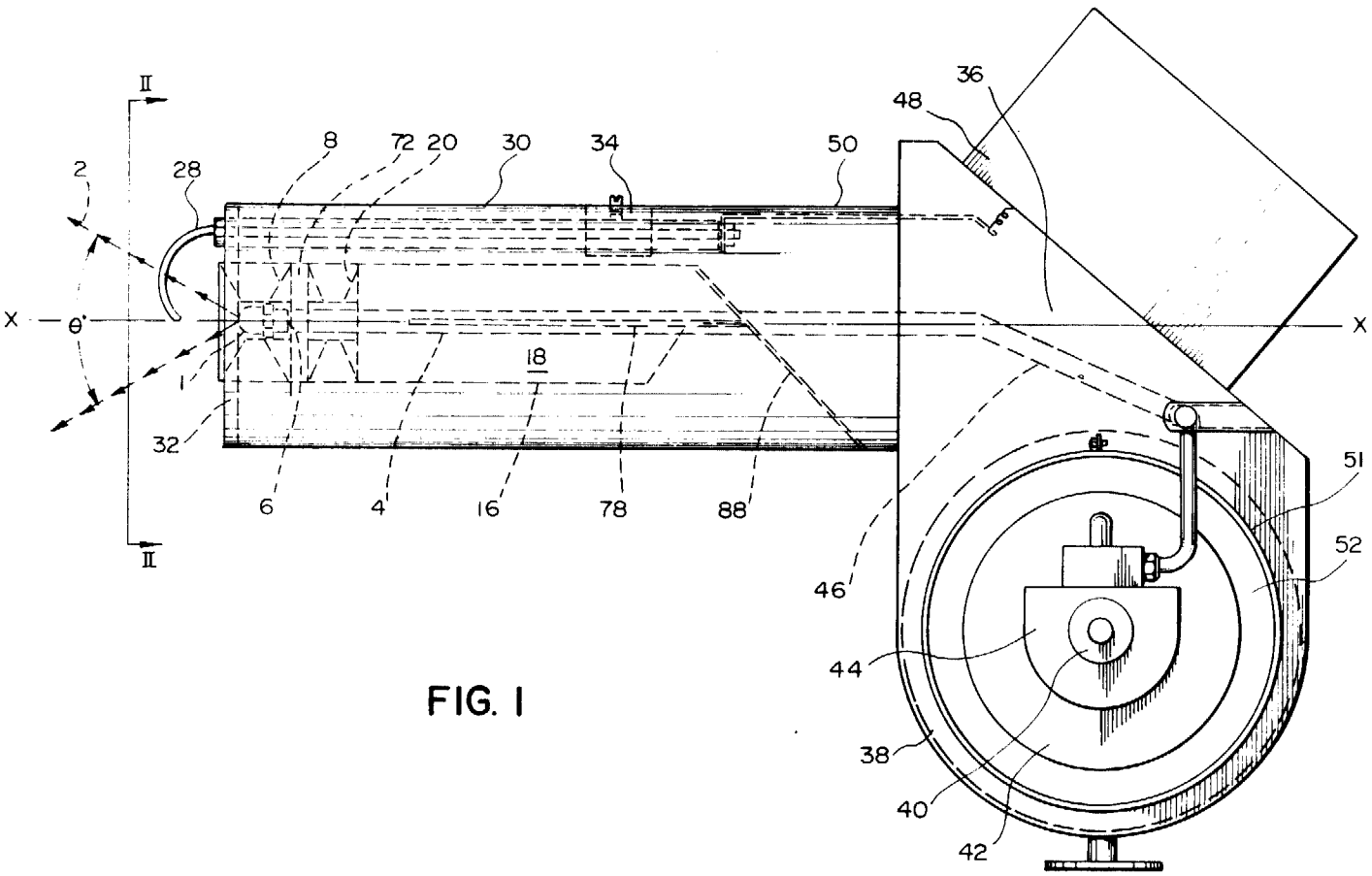

This invention relates to an oil burner assembly.

Conventional designs of oil burner assemblies for home heating fuel oils employ a traditional fuel/air mixing process in which the evaporation and combustion of the fuel oil take place simultaneously. In one form of oil burner assembly for home heating fuel oils the fuel oil is sprayed as a hollow cone and air is weakly swirled along a path which is parallel to the axis of a burner blast tube and which passes into the hollow cone so that the trajectories of the fuel oil droplets cross the air flow streamlines. This leads to a rapid evaporation giving fuel oil rich regions which in turn ignite under local sub-stoichiometric conditions producing soot, and results in air pollution as well as well as a waste of a fossil fuel.

The general pattern of the flame of such an oil burner assembly is one of heterogeneity in terms of fuel concentrations; the pockets of fuel lean mixture give rise to high nitric oxide concentrations from both the fuel nitrogen and the atmospheric nitrogen, while the pockets of fuel rich mixture give rise to soot. The visible flame from such a system is yellow. The yellow colour is the visible radiation from the high temperature soot particles and this completely masks other visible radiations as far as the human eye is concerned. These soot particles result from unburnt carbon.

For complete combustion of the carbon, that is soot-free combustion, the step-wise combustion of carbon to carbon dioxide via the intermediate carbon monoxide stage gives rise to a visible radiation in the blue region of the light spectrum. This can be attributed to the reaction $$CO + O \rightarrow CO_2 + h\nu,$$

where $h\nu$ is a quantity of light.

When this occurs the blue radiation becomes visible in a soot-free or low-luminosity flame, and oil burners for such soot-free flames are known as blue flame burners.

Various proposals have been made for blue flame burners. In U.S. Pat. No. 3,758,258, "Method For Combusting Fuels in a Substantially Conically Shaped Curtain", dated Sept. 11, 1973, Martic Ilmari Kolhi, there is shown a blue flame burner where the combustion air issues from an annular opening as a rotating cone around a fuel and air cone of fine oil droplets from a fuel nozzle and an air constriction therearound. The rotating cone of air, and the fuel and air cone, partially coincide creating a region of sufficient subpressure outside the respective fuel and air, and combustion air, cones so that the combustion zone is moved rearwardly and is concentrated radially inwardly. Thus combustion is effected more rapidly and a more rapid increase in temperature is obtained, resulting in the suppression of soot formation and the formation of other final products harmful to the environment.

While the blue flame burner described in the above mentioned U.S. Pat. No. 3,758,258, is undoubtedly an improvement over earlier burners, it is complex in that more than one air input is necessary in order to create a condition of sub-pressure outside the curtain of fuel and the combustion air envelope.

It would be desirable to provide a blue flame burner having one air input and wherein there was sufficient control of the rotating cone of combustion air, around a sprayed cone of oil droplets, so that the oil droplets more or less completely evaporate prior to combustion.

It is an object of the present invention to provide a blue flame burner having one air input and wherein there is sufficient control of the combustion air, around a sprayed cone of the oil droplets so that the oil droplets more or less completely evaporate prior to combustion.

According to the present invention there is provided an oil burner assembly, comprising:

a. an atomizing nozzle for spraying oil droplets substantially as a symmetrical hollow cone having an included angle for the outside edge of the oil spray, when the oil is sprayed in still air, in the range 60° to 80°, b. an oil supply tube connected to an oil inlet end of the atomizing nozzle, and having a longitudinal axis extending along the axis of symmetry of the hollow cone of oil droplets, c. an air swirler around the atomizing nozzle and extending rearwardly from the spraying end thereof, the air swirler comprising a plurality of similar blades equally spaced around the atomizing nozzle and extending therearound at a helix angle in the range 50° to 65° to the axis of symmetry of the hollow cone of oil droplets, with the edges of the blades adjacent the spraying end of the atomizing nozzle inclined in the direction of the hollow cone of oil droplets at an angle in the range 20° to 55° to the axis of symmetry of the hollow cone of oil droplets, d. an air supply tube for supplying air to the air swirler and extending rearwardly therefrom and coaxial with the oil supply tube, the air supply tube enclosing an air space around the oil supply tube, and e. an air pre-swirler on the oil supply tube, and spaced therealong from the air swirler, and comprising a plurality of blades which have a similar helix angle and direction of helix to the blades of the air swirler and which extend across an air outlet from the air space in the air supply tube, whereby, in operation, f. a substantially uniformly distributed air flow is produced to a flame burning the oil droplets, g. a substantially stable recirculation vortex within the flame is produced, and h. a region of rapid oil droplet and air mixing is established.

Figure 2:
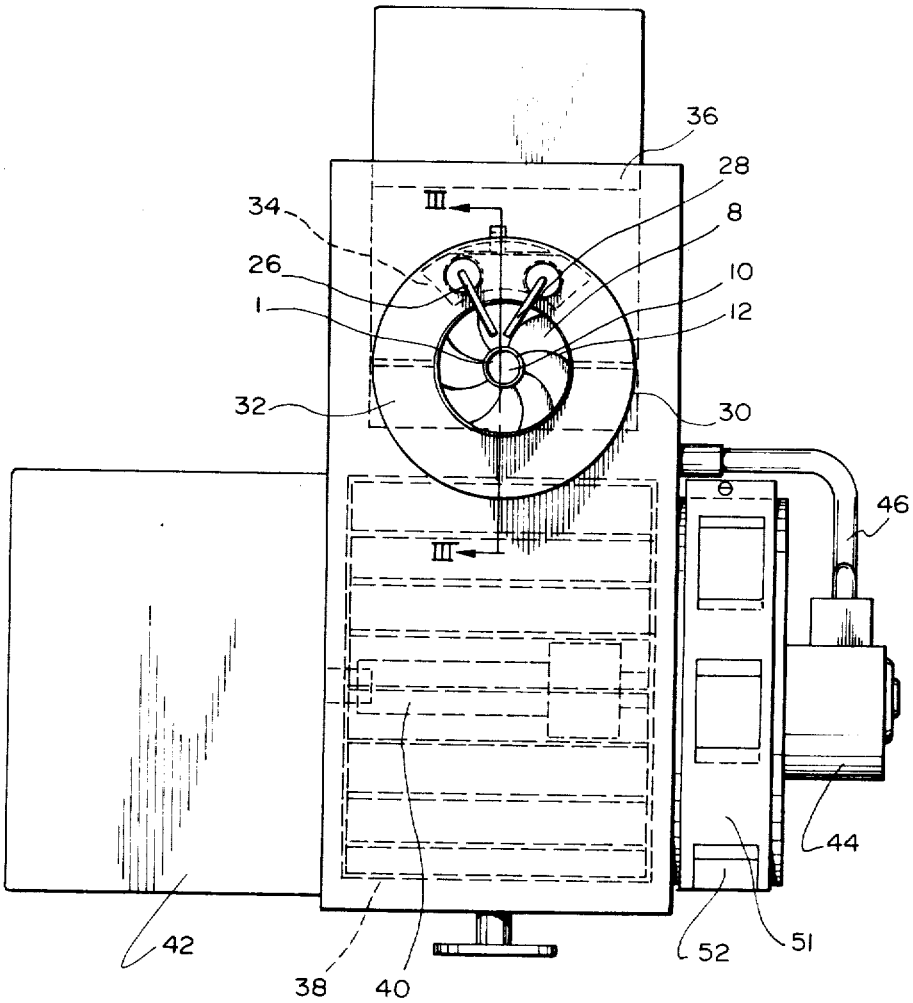
Figure 3:
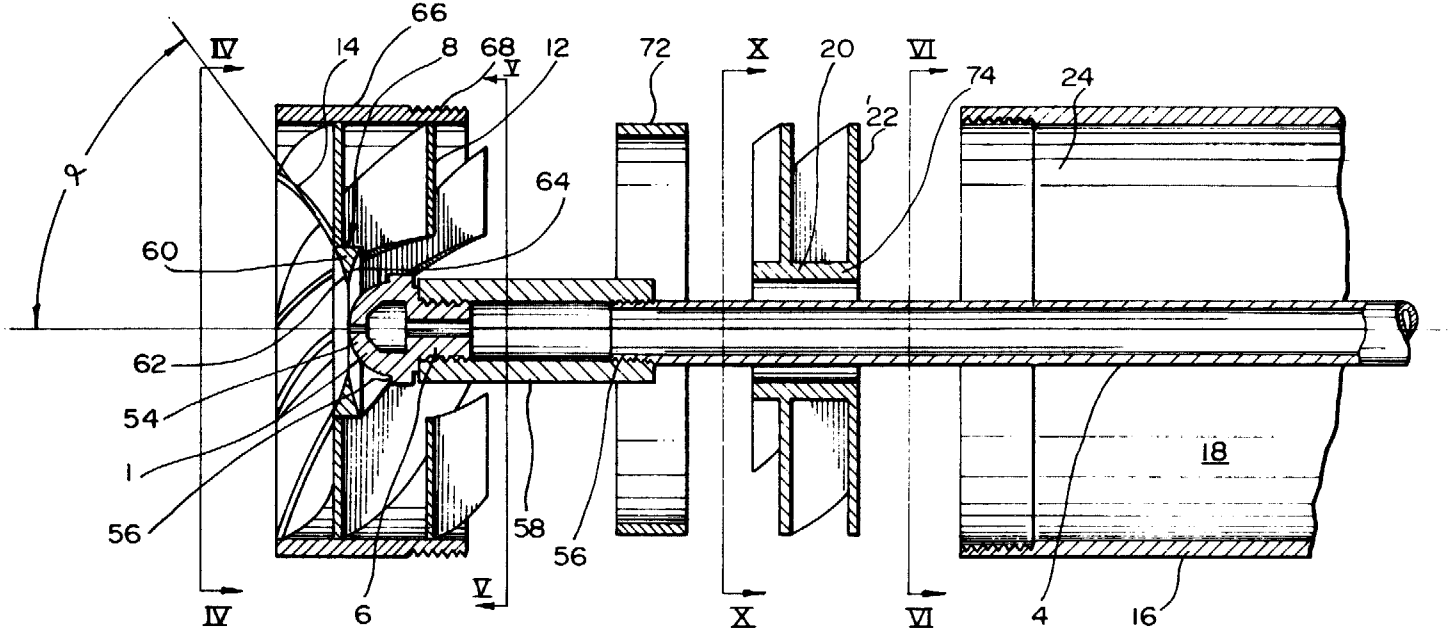
Figure 4:
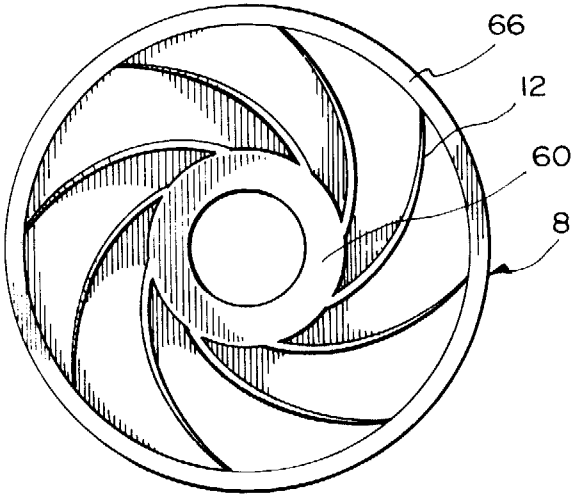
Figure 5:
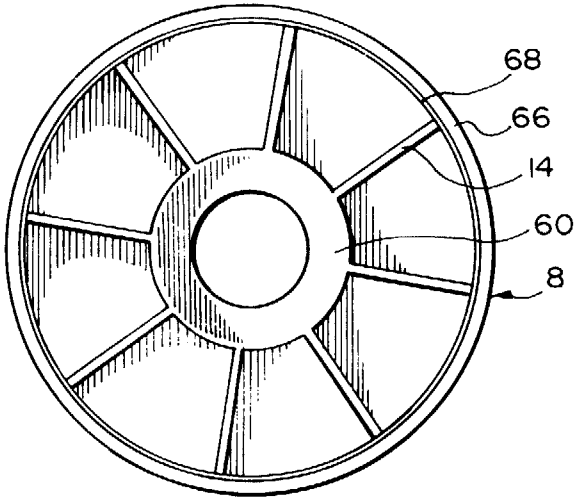
Figure 8:
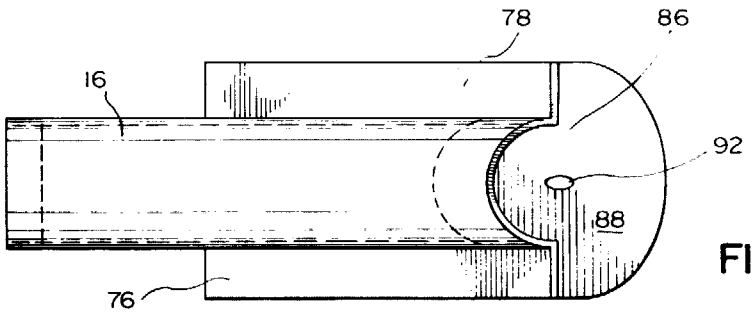
Figure 7:
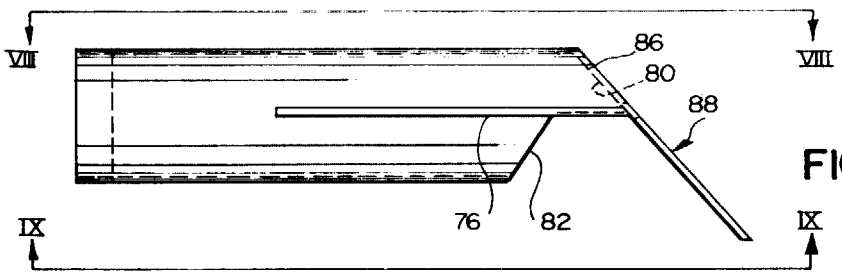
Figure 9:
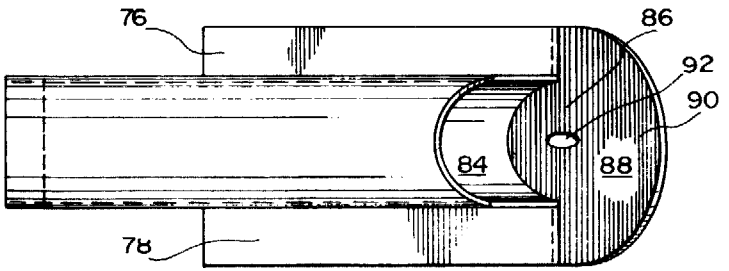
Figure 6:
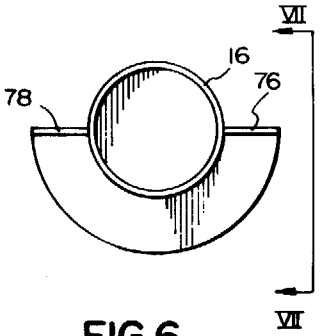

In the accompanying drawings which illustrate, by way of example, an embodiment of the present invention, FIG. 1 is a diagrammatic side view of an oil burner assembly, connected to an air fan, for a home heating system, FIG. 2 is a diagrammatic end view along II—II, FIG. 1, FIG. 3 is an enlarged, exploded, cross-sectional view of part of the oil burner assembly, along III—III, FIG. 2, FIG. 4 is a front end view of an air swirler shown in FIG. 3, in the direction IV—IV, FIG. 3, FIG. 5 is a rear view of the air swirler in the direction V—V, FIG. 3, FIG. 6 is a front end view of an air straightening and supply tube shown in FIG. 3, in the direction VI—VI, FIG. 7 is a side view in the direction VII—VII, FIG. 6, FIG. 8 is top view in the direction VIII—VIII, FIG. 7, and is above FIG. 7, FIG. 9, is an underside view in the direction IX—IX, FIG. 7, and is below FIG. 7.

Figure 11:
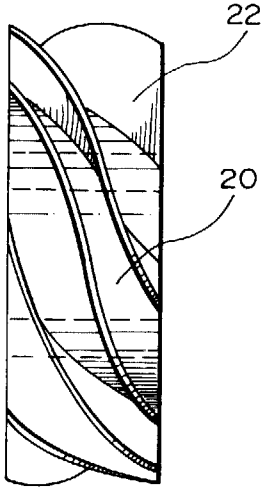
Figure 10:
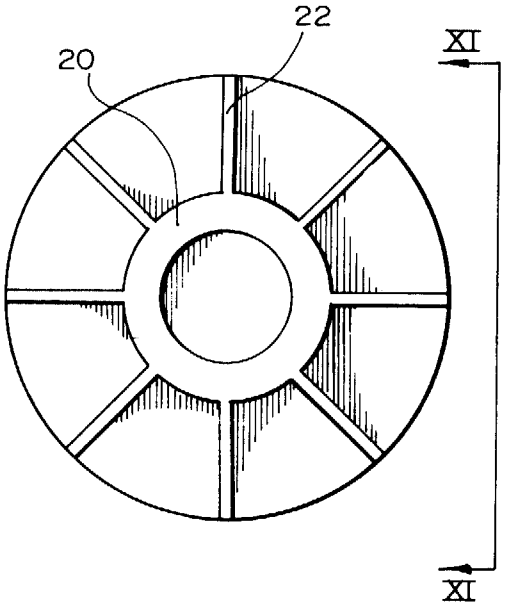
Figure 12:
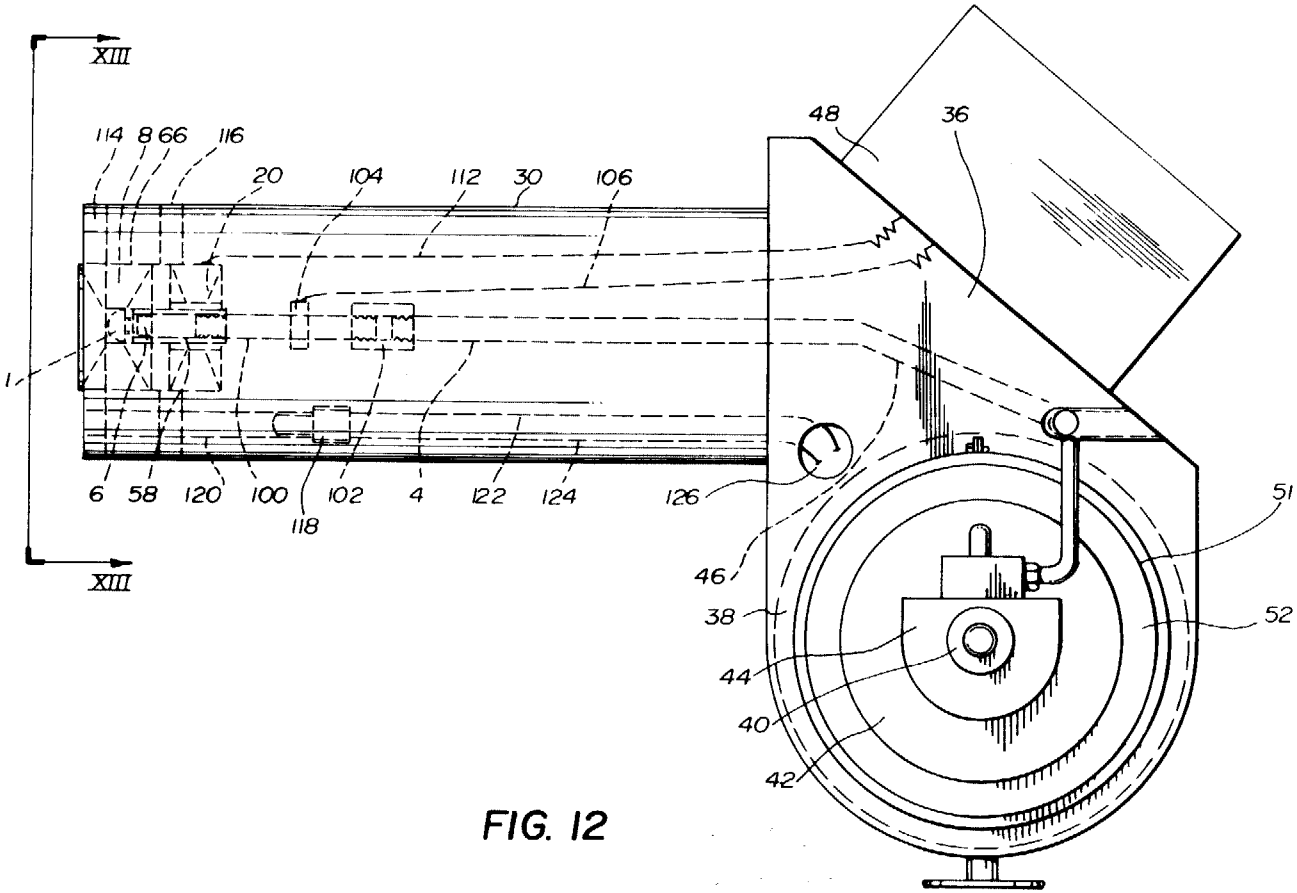
Figure 13:
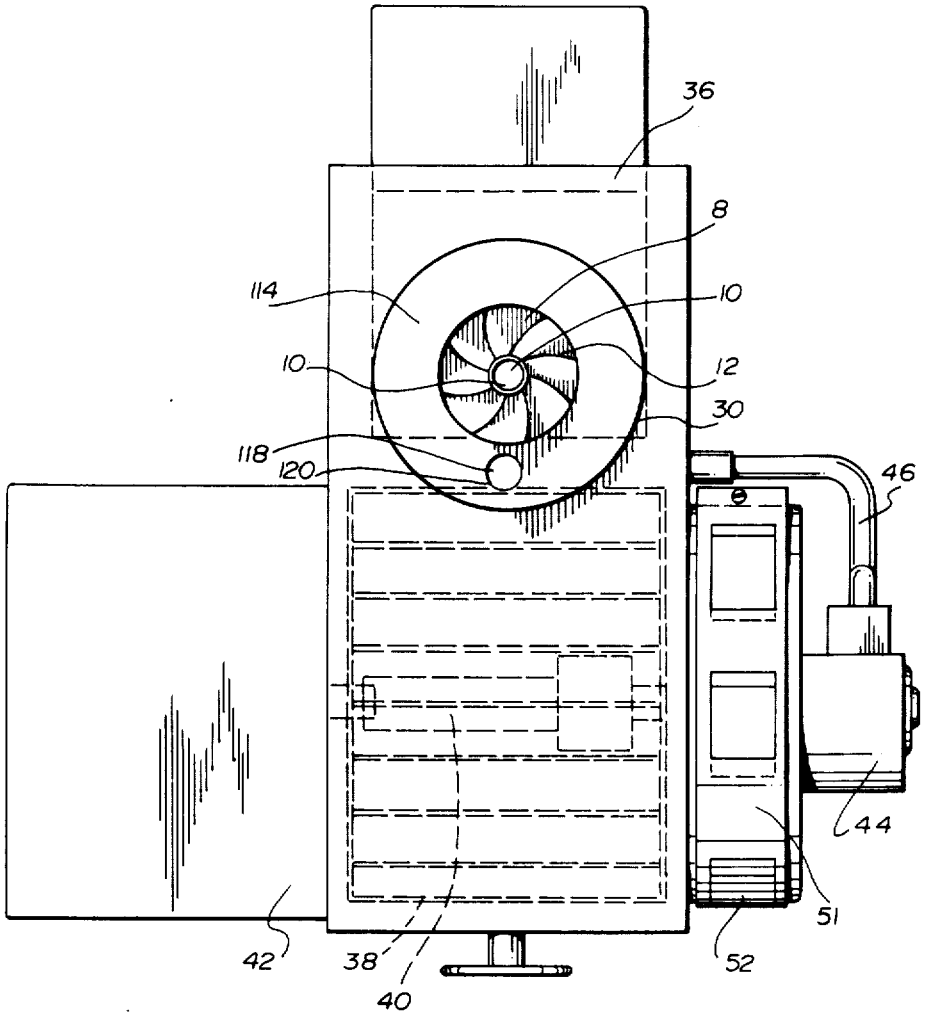
Figure 14:
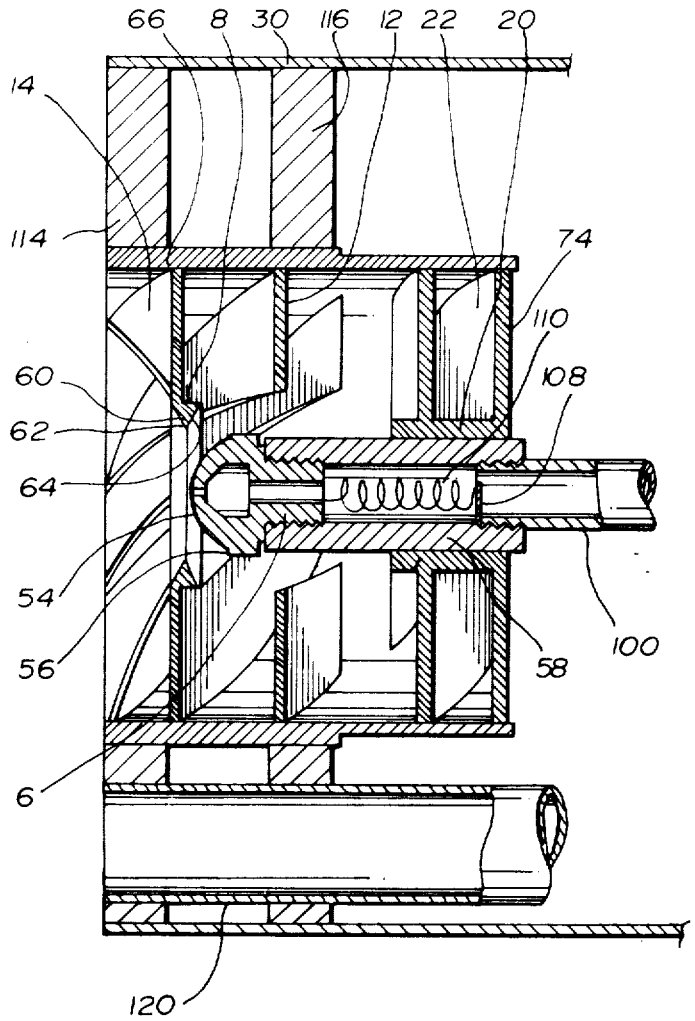

FIG. 10 is a front view of an air pre-swirler shown in FIG. 3 in the direction X—X, FIG. 3, FIG. 11 is a side view in the direction XI—XI, FIG. 10, FIG. 12 is a similar side view to that shown in FIG. 1 but of a different oil burner assembly, FIG. 13 is a diagrammatic end view along XIII—XIII, FIG. 12, FIG. 14 is a cross-sectional side view of a swirl head portion of the oil burner assembly shown in FIGS. 12 and 13.

Referring now to FIGS. 1 to 11 there is shown an oil burner assembly, comprising:

a. an atomizing nozzle 1 for spraying oil droplets substantially as a symmetrical hollow cone 2 having an included angle $\theta$ (FIG. 1) for the outside edge of the oil spray, when the oil is sprayed in still air, in the range 60° to 80°, in this embodiment 60°, b. an oil supply tube 4 connected to an oil inlet end 6 of th atomizing nozzle 1, and having a longitudinal axis extending along the axis of symmetry XX (FIG. 1) of the hollow cone 2 of oil droplets, c. an air swirler 8 around the atomizing nozzle 1 and extending rearwardly from the spraying end 10 thereof, the air swirler 8 comprising a plurality of, in this embodiment eight, similar blades 12 (FIGS. 2 and 3 to 5) equally spaced around the atomizing nozzle 1 and extending therearound at a helix angle in the range 50° to 65°, in this embodiment 60°, to the axis of symmetry XX (FIG. 1) of the hollow cone 2 of oil droplets, with the edges 14 (FIG. 3) adjacent the spraying end 10 of the atomizing nozzle 1 inclined in the direction of the hollow cone 2 (FIG. 1) of oil droplets at an angle (FIG. 3) in the range 20° to 55°, in this embodiment 50°, to the axis of symmetry XX (FIG. 1) of the hollow cone 2 of oil droplets, d. an air supply tube in the form of a firing tube 30 containing in this embodiment a longitudinally finned, air flow straightening and supply tube 16, for supplying air to the air swirler 8 (FIGS. 1 and 3) and extending rearwardly therefrom and coaxial with the oil supply tube 4, the firing tube 30 together with the air flow straightening and supply tube 16 enclosing an air space 18 (FIG. 1) around the oil supply tube 16, and e. an air pre-swirler 20 (FIGS. 1, 3, 10 and 11) on the oil supply tube 4, and spaced therealong from the air swirler 8, and comprising a plurality of, in this embodiment eight, blades 22 (FIGS. 3, 10 and 11) which have a similar helix angle and direction of helix, to the blades 12 of the air swirler 8 and which extend across an air outlet end 24 (FIG. 3) of the air space 18 in the firing tube 30 and the air flow straightening and supply tube 16, whereby, as will be described later, in operation, f. a substantially uniformly distributed air flow is produced to a flame burning the oil droplets, g. a substantially stable recirculation vortex within the flame is produced, and h. a region of rapid oil droplet and air mixing is established.

In this embodiment the atomizing nozzle 1, oil supply tube 4, air swirler 8, air flow straightening and supply tube 16 and air pre-swirler 20 are all mounted, together with two ignition electrodes 26 and 28, in the conventional firing tube 30 (FIGS 1 and 2). The air swirler 8 is mounted in an end plate 32 in the front end of the firing tube 30 and protrudes therethrough. The two ignition electrodes 26 and 28 extend through, and are electrically insulated, from the end plate 32 and are mounted in the firing tube 30 by means of a conventional electrode mounting and adjustment 34.

The firing tube 30 is mounted on the outlet of an air chamber 36 (FIGS. 1 and 2) of an air fan 38 which is coupled by a clutch-coupling 40 to an electric motor 42. An oil pump 44 is also driven by the clutch-coupling 40 and is mounted on the side of the air chamber 36. The oil pump 44 is connected to the oil supply tube 4 by an oil pipe 46. An ignition transformer 48 is connected by two electrode connectors, one of which is shown and designated 50 (FIG. 1) to each of the ignition electrodes 26 and 28. An air damper 51 is provided around an air inlet 52 to the air chamber 36.

If desired the clutch-coupling 40 may be omitted and a time-delay solenoid valve fitted in the oil pipe 46.

As shown in FIG. 3 the atomizing nozzle 1 has a domed, spraying end 54 with a shoulder 56, and oil inlet end 6 is screw threaded externally. The oil supply tube 4 has an externally screw threaded end 56 which is connected to the oil inlet end 6 of the atomizing nozzle 1 by a connecting tube 58 having internally screw threaded ends.

Referring to FIGS. 3 to 5, the air swirler 8 has an inner, annular boss 60 upon which the blades 12 are mounted. The boss 60 has chamfered sides 62 and 64, the chamfered side 62 being inclined in the same manner as the edges 14 of the blades 12, the chamfered side 64 is spaced from and centered with the atomizing nozzle 1. A cylindrical casing 66 is conveniently attached to and surrounds the outer perimeters of the blades 12, and is externally threaded at 68 for attachment to an internally threaded portion 70 of the air flow straightening and supply tube 16. It should be noted, however, that cylindrical casing 66 is not essential for the operation of the air swirler 8. The rear edges of the blades 12 are substantially at right angles to the axis of symmetry XX (FIG. 1) of the hollow cone 2 of oil droplets.

A spacer ring 72 is a slidable fit in the bore of the air flow straightening and supply tube 16, and buts up on to the end of the threaded section 68 of the cylindrical casing 66 to space the air pre-swirler 20 from the air swirler 8.

Referring now to FIGS. 3 and 10 and 11 the air pre-swirler 20 comprises the blades 22 and an inner, annular boss 74 upon which the blades 22 are mounted. The annular boss 74 is slidable on the connecting tube 58 and is securable thereon by means not shown. The blades 22 are a slide fit in the bore of the air flow straightening and supply tube 16 and are preferably spaced half a pitch circumferentially from the blades of the air swirler. While the air pre-swirler 20 is shown as having the same number of blades 22 as the air swirler 8 (FIG. 3) it is possible for the air pre-swirler to have a different number thereto provided that the helix angle and direction of helix is the same as the blades of the air swirler 8. As shown in FIGS. 6 to 9 the air flow straightening and supply tube 16 has two radial fins 76 and 78 extending longitudinally therealong for a major portion of the length thereof from the rear end. The fins 76 and 78 are a slide fit in the bore of the firing tube 30 (FIG. 1). One half of the rear end 80 of the air flow straightening and supply tube 16 is inclined rearwardly towards the longitudinal axis thereof and extends rearwardly beyond the other half 82 to provide an air inlet 84 forward of a baffle 88. The half 80 is closed by one oval side portion 86 of the baffle 88 which is inclined in the same manner as the half 80. The other oval side portion 90 of the baffle 88 closely fits the bore of the firing tube 30 (FIG.

1) to seal the side of the firing tube interior which is opposite to the sealed half 80.

The blades 22 of the air pre-swirler 20 may be aligned helically with the blades of the air swirler 8, or may be offset at any pitch. It has been found that by offsetting the air pre-swirler blades 22 at one half pitch to the blades of the air swirler 8 an effect substantially equal to an air pre-swirler 20 having twice the number of blades is obtained. The baffle 88 has a hole 92 for the oil supply tube 4 (FIG. 1) and the radial fins 76 and 78 extend rearwardly to the baffle 88.

In operation the apparatus is assembled as shown in FIGS. 1 and 2, the electric motor 42 started and the ignition electrodes 26 and 28 energized by the ignition transformer 48. The clutch-coupling 40 is operated so that the electric motor 42 drives the air fan 38 to deliver air to the firing tube 30, and drives the oil pump 44 to deliver oil to the oil supply tube 4.

The oil supply tube 4 delivers the oil at about 100 psi to the atomizing nozzle 1 which produces a mechanically atomized oil spray in the form of a hollow cone of oil droplets 2 (FIG. 1), having an included angle $\theta$ (FIG. 1) of 60°, while the air to the firing tube 30 is deflected by the baffle 88 to travel in a forward direction along the upper half of the firing tube 30, above the fins 76 and 78 to the end plate 32 and then rearwardly below the fins 76 and 78 to the air inlet 78. By causing the air to travel along the firing tube 30 in this manner the air, which is the combustion air, has the air flow thereof straightened, is pre-heated, and cools the ignition electrodes 26 and 28 and the end plate 32.

The air entering the air inlet flows forwardly along the interior of the air flow straightening and supply tube, where the air flow is further straightened, is pre-swirled as it passes between the blades 22 (FIGS. 3, 10 and 11) of the pre-swirler 20 and given a final swirl by passing between the blades 12 (FIGS 2, 4 and 5) of the air swirler 8.

The oil droplets 2 in the hollow cone are carried by the swirling air, which diffuses with them in such a manner, that after initial spark ignition by the ignition electrodes 26 and 28, the oil droplets, being continuously sprayed from the atomizing nozzle, are evaporated prior to combustion and;

i. a substantially uniformly distributed air flow is produced to a flame burning the oil droplets, g. a substantially stable recirculation vortex in the flame is produced, and h. a region of rapid oil droplet and air mixing is established, and this results in a surprisingly stable blue flame.

Inclining the edges 14 (FIG. 3) of the blades 12 at an angle $\alpha$ in the range 20° to 55° permits the entrant air to diverge and mix intimately with the oil droplets and enclose a flame recirculation vortex situated along the axis of symmetry of the resultant flame, which happens to coincide with the axis of symmetry XX (FIG. 1) of the hollow cone 2 of oil droplets. This flame recirculation cone acts as a source of heat and reactive species which serve to raise the temperature of and stabilize the ignition of the conical air/fuel oil droplet mixture generated by the atomizing nozzle 1 and the air swirler 8. This is caused by the inclined edges 14 of the blades 12 of the air swirler 12 causing progressively less frictional drag, towards the axis of symmetry XX, on air passing between the blades 12.

As an example of the embodiment shown in FIGS. 1 to 11, tests were made using oil firing rates in the range 0.65 to 1.25 US gph, the air swirler and air pre-swirler had an external vane diameter of 1.88 inches, their annular bosses were 0.95 inches diameter with central bores of 0.725 inches diameter, the separation distance of the spacer ring was 0.28 inches.

The results of the tests were,

| | | | | | | |
|---|---|---|---|---|---|---|
| ATOMIZING NOZZLE | | | | | | |
| Firing Rate | US gph | 0.65 | 0.75 | 0.85 | 1.00 | 1.25 |
| Spray Angle ($\theta$) | | 60°-80° | 60°-80° | 60°-80° | 60°-80° | 60°-80° |
| Operating Pressure | psi | 100 | 100 | 100 | 100 | 100 |
| AIR FLOW STRAIGHTENING AND SUPPLY TUBE | | | | | | |
| Inside Diameter | Inches | 1.88 | 1.88 | 2.10 | 2.10 | 2.10 |
| Outside Diameter | Inches | 2.06 | 2.06 | 2.30 | 2.30 | 2.30 |
| AIR PRE-SWIRLER | | | | | | |
| No. of Vanes | | 8 | 8 | 8 | 8 | 8 |
| Vane Helix Angle - degrees | | This should match the vane helix angle in the air swirler. | | | | |
| Minimum | | 50° | 50° | 50° | 50° | 50° |
| Maximum | | 65° | 65° | 65° | 65° | 65° |
| Optimum | | 60° | 60° | 60° | 60° | 60° |
| Length | | | | | | |
| Minimum | Inches | 0.5 | 0.5 | 0.5 | 0.5 | 0.5 |
| Optimum | Inches | 0.68 | 0.68 | 0.68 | 0.68 | 0.68 |
| AIR SWIRLER | | | | | | |
| No. Of Vanes | | 8 | 8 | 8 | 8 | 8 |
| Vane Helix Angle | | | | | | |
| Minimum | | 50° | 50° | 50° | 50° | 50° |
| Maximum | | 65° | 65° | 65° | 65° | 65° |
| Optimum | | 60° | 60° | 60° | 60° | 60° |
| Angle of Inclined Edges | | | | | | |
| Minimum | | 20° | 20° | 20° | 20° | 20° |
| Maximum | | 55° | 55° | 55° | 55° | 55° |
| Optimum | | 50° | 50° | 50° | 50° | 50° |
| Length | | | | | | |
| Minimum | Inches | 1.225 | 1.225 | 1.225 | 1.255 | 1.255 |

In other embodiments of the present invention the air is delivered directly to the interior of the air flow straightening and supply tube, and the longitudinal fins are then in the air flow straightening and supply tube and extend from the inner wall thereof to the oil supply tube. However, care should be taken to ensure that the air flow is uniformly distributed prior to it reaching the rear face of the air pre-swirler.

In some embodiments of the present invention the spacer ring 72 (FIG. 3) is not provided and the spacing of the air pre-swirler 20 from the air swirler 8 is achieved and maintained by the securement of the air pre-swirler 20 on an extended cylindrical casing 66 (FIG. 14).

In other embodiments of the present invention the air straightening and supply tube 16 (FIGS. 1 and 6 to 9) is not provided.

In some embodiments of the present invention it has been found that the two ignition electrodes 26 and 28 (FIG. 2) may give rise to soot in the flame and in these circumstances a different ignition system is preferably used. Thus it is within the scope of the present invention to electrically insulate the air swirler 14 (FIG. 3) from the domed spraying end 54 of the atomizing nozzle 1 and provide means for causing an ignition spark electrical discharge between the air swirler 14 and the domed spraying end 54.

In FIGS. 12 to 18 similar parts to those shown in FIGS. 1 to 5 and 10 and 11 are designated by the same reference numerals and the previous description is generally relied upon to describe them.

FIGS. 12 to 14 show an oil burner assembly wherein a spacer ring 72 (FIG. 3) and air straightening and supply tube 16 (FIGS. 1 and 6 to 9) are not provided and wherein the ignition spark occurs between the atomizing nozzle 1 and the air swirler 8 thus dispensing with the two ignition electrodes 26 and 28 (FIG. 2).

In FIGS. 12 to 14 the connecting tube 58 is of a dielectric material, for example the dielectric material marketed under the trade mark "Delrin" by Cadillac Products, Toronto and is connected to the oil supply tube 4 by a copper pipe 100 and a screw threaded coupling tube 102 (FIG. 12) of a dielectric material such as that from which the connected tube is composed. The copper pipe 100 has a cable connecting sleeve 104 which electrically connects the copper pipe 100 to an electrical conductor 106 from the ignition transformer 48. The copper sleeve 100 has an electrical terminal post 108 (FIG. 14) which is electrically connected to the domed, spraying end 54 by a coiled electrical conductor 110. The domed spraying end 54 is of an electrically conducting metal.

The cylindrical casing 66 is of an electrically conducting metal and is attached to the perimeters of the blades 12 by an electrically conducting joint, e.g. a brazed joint. The blades 22 of the air pre-swirler 20 are a slide fit in the cylindrical casing 66 and are located in an end portion thereof forming an air outlet from the firing tube 30. The cylindrical casing 66 is connected to an electrical conductor 112 (FIG. 12) from the ignition transformer 48 and is not externally threaded in this embodiment.

The cylindrical casing 66 is mounted in the firing tube 30 by two locating rings 114 and 116 which are of a dielectric material, for example the dielectric material marketed under the trade mark Transite by John Manville Ltd.

A flame sensing device 118, which may be a conventional cadmium sulphide cell, is mounted at the rear end of an open ended tube 120. The tube 120 is mounted in the locating rings 114 and 116. The flame sensing device 118 is connected by electrical cables 122 and 124 extending through a seal 126 to a conventional furnace control unit (not shown) to cut off the electrical power to the whole boiler system in response to detecting that the flame has become extinct.

In operation the embodiment shown in FIGS. 12 to 14 functions in the same manner as the embodiment shown in FIGS. 1 to 11 except that the air flows directly along the firing tube 30 from the air fan 38 to the air pre-swirler 20, and the ignition spark is produced by an electrical discharge between the domed spraying end 54 of the atomizing nozzle 1 and the annular boss 60 of the air swirler 8.

In other embodiments of the present invention the coiled electrical conductor 110 (FIGS. 12 and 14) is replaced by an electrically conductive metal layer on the inner surface of, and extending the length of the connecting tube 58.

In other embodiments of the present invention the coiled electrical cable 10 (FIGS. 12 and 14) is omitted, the connecting tube 58 is of an electrically conductive metal, and the air pre-swirler 20 is electrically insulated from the connecting tube 58 by means of a sleeve of electical insulating material separating the air pre-swirler 20 from the connecting tube 58.

We claim:

1. An oil burner assembly, comprising:

a. an atomizing nozzle for spraying oil droplets substantially as a symmetrical hollow cone having an included angle for the outside edge of the oil spray, when the oil is sprayed in still air, in the range 60° to 80°, b. an oil supply tube connected to an oil inlet end of the atomizing nozzle, and having a longitudinal axis extending along the axis of symmetry of the hollow cone of oil droplets, c. an air swirler around the atomizing nozzle and extending rearwardly from the spraying end thereof, the air swirler comprising a plurality of similar blades equally spaced around the atomizing nozzle and extending therearound at a helix angle in the range 50° to 65° to the axis of symmetry of the hollow cone of oil droplets with the edges of the blades adjacent the spraying end of the atomizing nozzle inclined in the direction of the hollow cone of oil droplets at an angle in the range 20° to 55° to the axis of symmetry of the hollow cone of oil droplets, d. an air supply tube for supplying air to the air swirler and extending rearwardly therefrom and coaxial with the oil supply tube, the air supply tube enclosing an air space around the oil supply tube, and e. an air pre-swirler on the oil supply tube, and spaced therealong from the air swirler, and comprising a plurality of blades which have a similar helix angle and direction of helix to the blades of the air swirler and which extend across an air outlet from the air space in the air supply tube, whereby, in operation, f. a substantially uniformly distributed air flow is produced to a flame burning the oil droplets, g. a substantially stable recirculation vortex within the flame is produced, and h. a region of rapid oil droplet and air mixing is established.

2. An oil burner assembly according to claim 1, wherein the air supply tube is a firing tube, and air flow straightening and supply tube is in the firing tube and is longitudinally finned externally on opposed sides and has an outlet end to the air pre-swirler, the firing tube encloses the atomizing nozzle, the air swirler, the air pre-swirler and the air flow straightening and supply tube, with the longitudinal fins on the air flow straightening and supply tube extending to the firing tube, a baffle inclined in the direction of air flow seals half the rear end of the air flow straightening and supply tube and the opposite side thereto of the firing tube, with an air inlet to the air flow straightening and supply tube forward of the baffle, and an end plate seals the air swirler in a front end of the firing tube.

3. An oil burner according to claim 1, wherein the air pre-swirler has the same number of blades as the air swirler and the blades of the air pre-swirler are spaced one half a pitch circumferentially from the blades of the air swirler.

4. An oil burner according to claim 1, wherein a flame detector is mounted in the air supply tube for detecting when a flame burning the oil droplets has become extinct.

* * * * *